United States Patent [19]

Teetz et al.

[11] 4,254,721

[45] Mar. 10, 1981

[54] DEVICE FOR THE INTERMITTENT INTERRUPTION OF THE EMBROIDERY NEEDLE MOVEMENT ON EMBROIDERY- OR SEWING MACHINES

[75] Inventors: Wolfgang Teetz, Kerken; Alfred Desprez, Wachtendonk, both of Fed. Rep. of Germany

[73] Assignee: Maschinenfabrik Carl Zangs Aktiengesellschaft, Krefeld, Fed. Rep. of Germany

[21] Appl. No.: 958,401

[22] Filed: Nov. 7, 1978

[30] Foreign Application Priority Data

Nov. 7, 1977 [DE] Fed. Rep. of Germany ..... 2749700

[51] Int. Cl.[3] ..... D05B 55/16

[52] U.S. Cl. ..... 112/221

[58] Field of Search ..... 112/221, 83, 84, 85, 112/86, 98

[56] References Cited

U.S. PATENT DOCUMENTS

| | | | |
|---|---|---|---|
| 2,314,339 | 3/1943 | Bradwell | 112/221 X |
| 3,695,199 | 10/1972 | Rolauffs et al. | 112/221 |
| 3,709,172 | 1/1973 | Comerio | 112/84 |
| 3,884,165 | 5/1975 | Tajima | 112/83 |
| 4,054,098 | 10/1977 | Hoever et al. | 112/221 X |
| 4,098,207 | 7/1978 | Peterson | 112/221 |

*Primary Examiner*—H. Hampton Hunter

*Attorney, Agent, or Firm*—Martin A. Farber

[57] ABSTRACT

A device for the intermittent interruption of the embroidery needle movement on automatically controlled embroidery- or sewing- machines, particularly multiple head automation embroidery machines, with at least one needle bar, the latter being driven by means of a crank rod and a crank from a drive shaft. The crank rod is pivotally connected with a drive carriage. By means of a pawl the drive carriage can be connected with a driver which is fastened on the needle bar. The driver in its turn is able to be secured in an upper deadpoint position by means of a controllable holding pawl with the simultaneous separation or disconnection of the drive carriage.

18 Claims, 6 Drawing Figures

Figure 1:
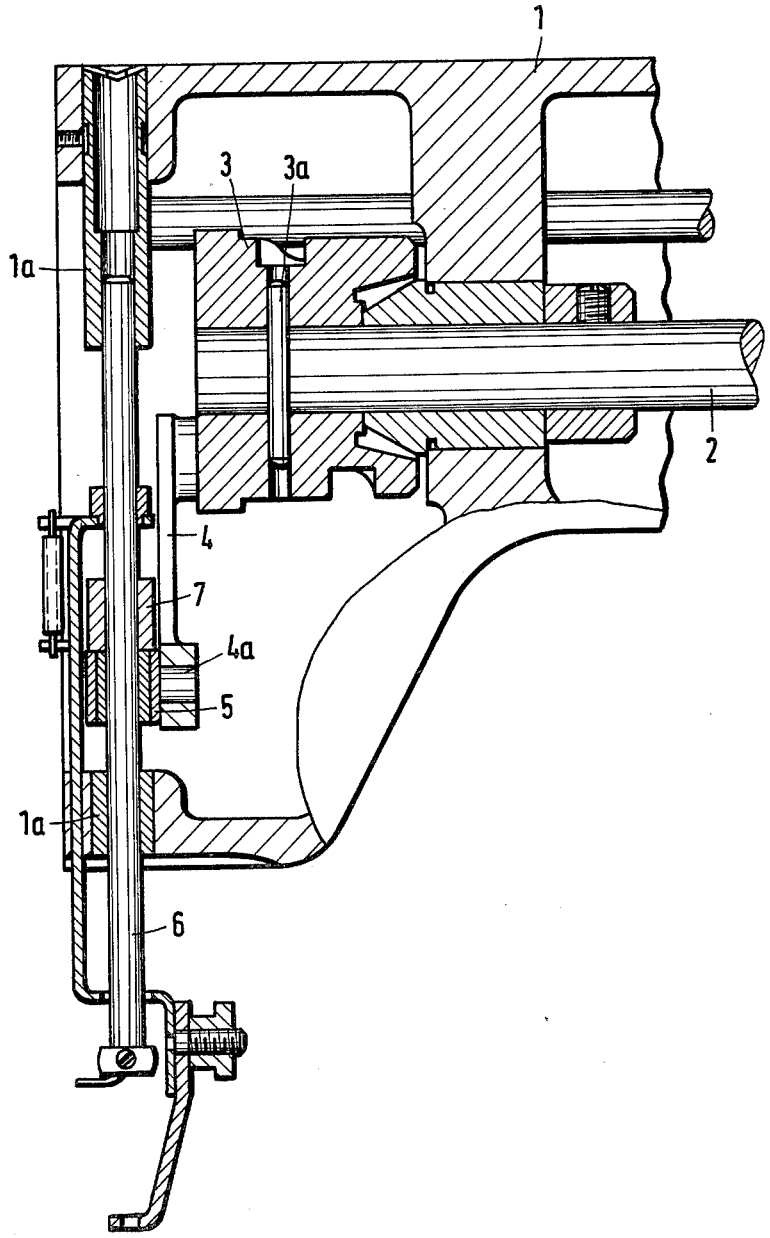

DEVICE FOR THE INTERMITTENT INTERRUPTION OF THE EMBROIDERY NEEDLE MOVEMENT ON EMBROIDERY- OR SEWING MACHINES

The invention relates to a device for the intermittent interruption of the embroidery needle movement on automatically controlled embroidery- or sewing- machines, particularly multiple head automatic embroidery machines, with at least one needle bar, the latter being driven by means of a crank rod and a crank from a drive shaft.

With automatically controlled embroidery- or sewing machines, so-called skip stitches, herein called jump stitches are necessary when the embroidery frame which carries the material to be embroidered is automatically shifted from one motif or pattern to the other. These jump stitches which connect the space between the last stitch of the finished motif with the first stitch of the new pattern must be separated apart by hand after the completion of the embroidery. In this manner there results not only the necessity of an after-treatment of the material which is automatically embroidered on the machine manually, but altogether a considerable additional working expense.

In order to avoid separating out the jump stitches after completion of the embroidery, it is already known to provide automatic embroidery machines with a device by which the stitch formation can be intermittent or skipped from time to time. With this known device by means of a magnet the needle rod or shank turns in the block by about 90°, the latter causing its back and forth movement, so that as a consequence of the simultaneous rotation of the needle which is fastened on the needle bar or rod, the shuttle or gripper cannot receive or hold the loops of the threads, whereby the formation of stitches is prevented.

The known device indeed interrupts the formation of jump stitches, however does not avoid the penetration of the needle in the embroidery background. With different materials to be embroidered consequently undesired needle stitches remain visible, which are particularly disturbing when the embroidery background material is made of leather, synthetic leather or fine textile fabrics.

The invention is based on the task to create a device for the intermittent or temporary interruption of the embroidery needle movement on automatically controlled embroidery or sewing machines, particularly multiple head automatic embroidery machines, by which not only can the stitch formation be intermittently or temporarily interrupted, but rather a controlled interruption of the embroidery needle movement is possible with simple means without problem, without large changes in the construction of the embroidery head being necessary.

The solution of this task by the invention is featured in the manner that the crank rod is pivotally connected with a drive carriage, which carriage is connectable with a driver fastened on the needle bar by means of a pawl, the driver in its turn being arrestable or able to be secured in an upper deadpoint position by means of a controllable holding pawl with simultaneous separation or disconnection of the drive carriage.

With the formation in accordance with the invention it is possible to hold the needle bars fixed in the upper deadpoint position without interrupting the movements of the needle bar drive, namely the drive shaft, the crank and the crank rod. Particularly with an automatic displacement of the embroidery frame between two motifs or patterns, consequently the embroidery needle movement can be intermittently or temporarily interrupted without the machine drive being switched off or disconnected, since this drive is required for execution of the embroidery frame displacement.

According to a further feature of the invention the drive carriage is moveably guided on the needle bar and the pawl is directly mounted on the driver. In this manner there results also a particularly simple embodiment which particularly finds use for embroidery machines without color change.

With an alternate embodiment of the invention the drive carriage is moveably guided on a guide rod, the latter being arranged parallel to the needle bar, and the pawl is mounted on a contact member, the latter likewise being guided on the guide rod and being connected with the driver of the needle bar. This embodiment is particularly suited for embroidery automation machines with a color change device. With such a type of embroidery machines according to the invention several needle rods are mounted moveably parallel to one another in a common needle bar block, the latter being displaceable transversely to the embroidery movement, whereby the driver of that needle bar which is located respectively at the time in the embroidery position is connected with the contact member.

A further formation in accordance with the invention of one such type of embroidery machine resides in that the driver of each needle bar is provided with a roller which is insertable in a fork-shaped recess of the contact member. According to a further feature of the invention at both sides of the contact member which is located in the upper deadpoint position, there is arranged respectively each one stationary guide curve track for the rollers of the needle bars which are located outside of the embroidery position. In this manner with simple means without problems there exists a possibility for interruption of the embroidery needle movement on multiple needle embroidery machines with a color change device, the disconnected needle bars of which are reliably secured. According to a further feature of the invention each disconnected needle is held at a sufficient spacing from the material to be embroidered, in the manner that the spacing of each guide curve increases from the table of the embroidery- or sewing machine with increasing distance from the contact member.

With a preferred formation of the device in accordance with the invention the pawl is formed as a double-arm lever of which one arm cooperates with a catch which is formed on the drive carriage and the other arm cooperates with the holding pawl. According to the invention the holding pawl is controlled by means of a switching or driving magnet.

In order to increase the reliability of the switching operation, in accordance with the invention the holding pawl is biased by a leg spring. So that a reliable interruption of the embroidery needle movement takes place even with high rotational speeds of the machine, the driver and the contact piece, respectively, is biased by a tension spring, the latter pulling these parts into the upper deadpoint position.

The device in accordance with the invention provides the advantage that with simply constructive means, the embroidery needle movement can be controlled and interrupted, whereby according to a further feature of the invention the switching magnet is controlled by the program of the automatic control of the embroidery- or sewing machine.

Figure 2:
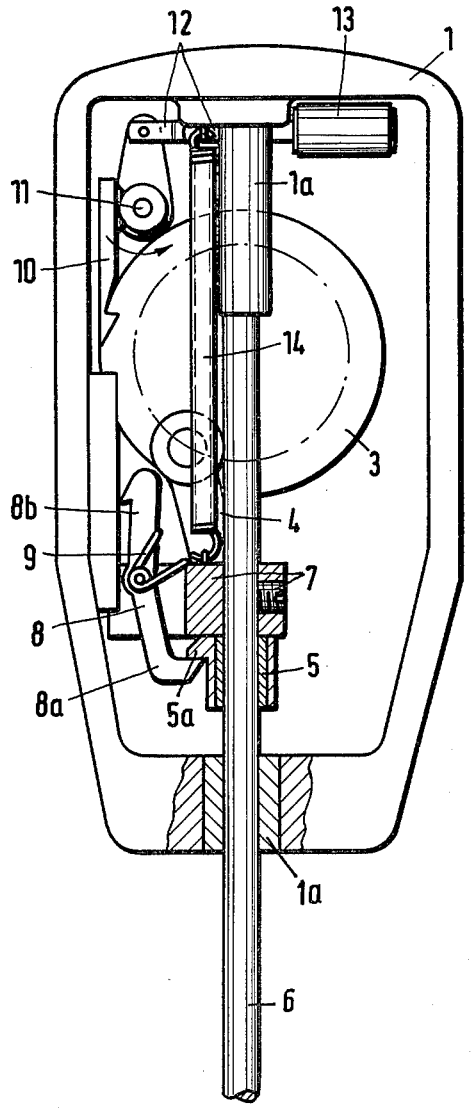
Figure 3:
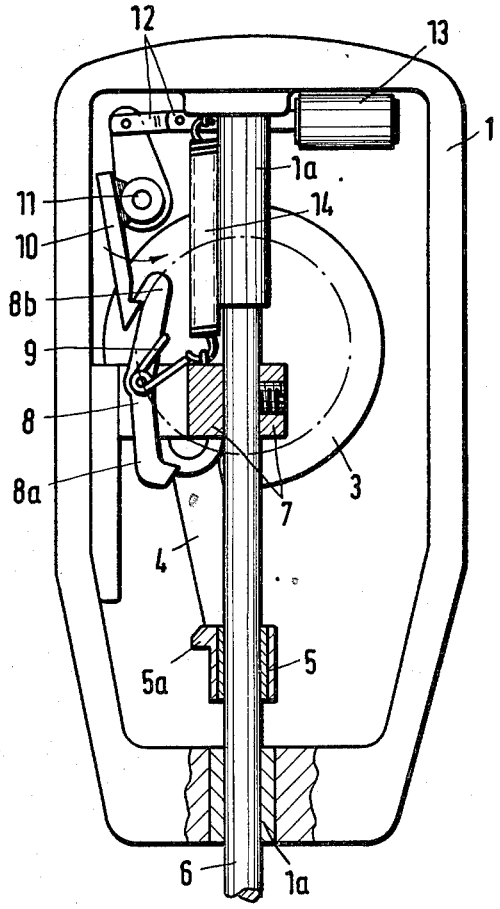
Figure 4:
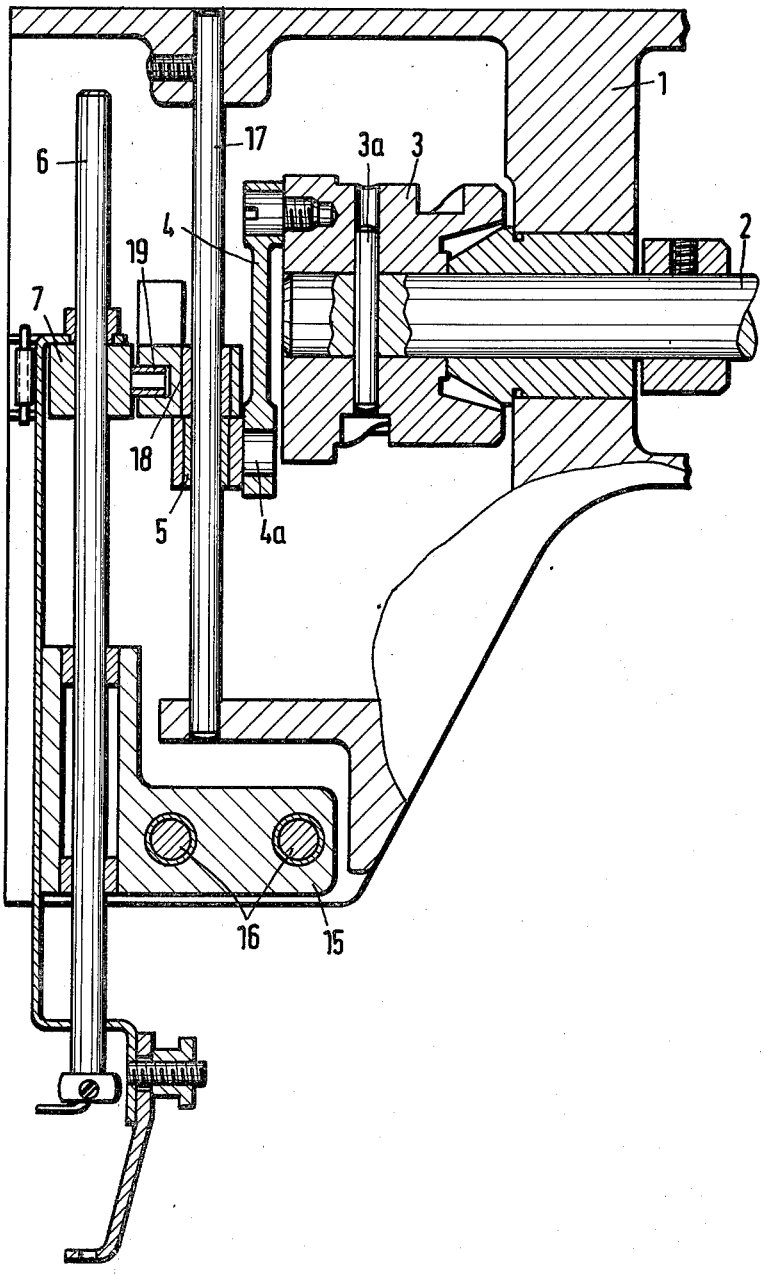
Figure 5:
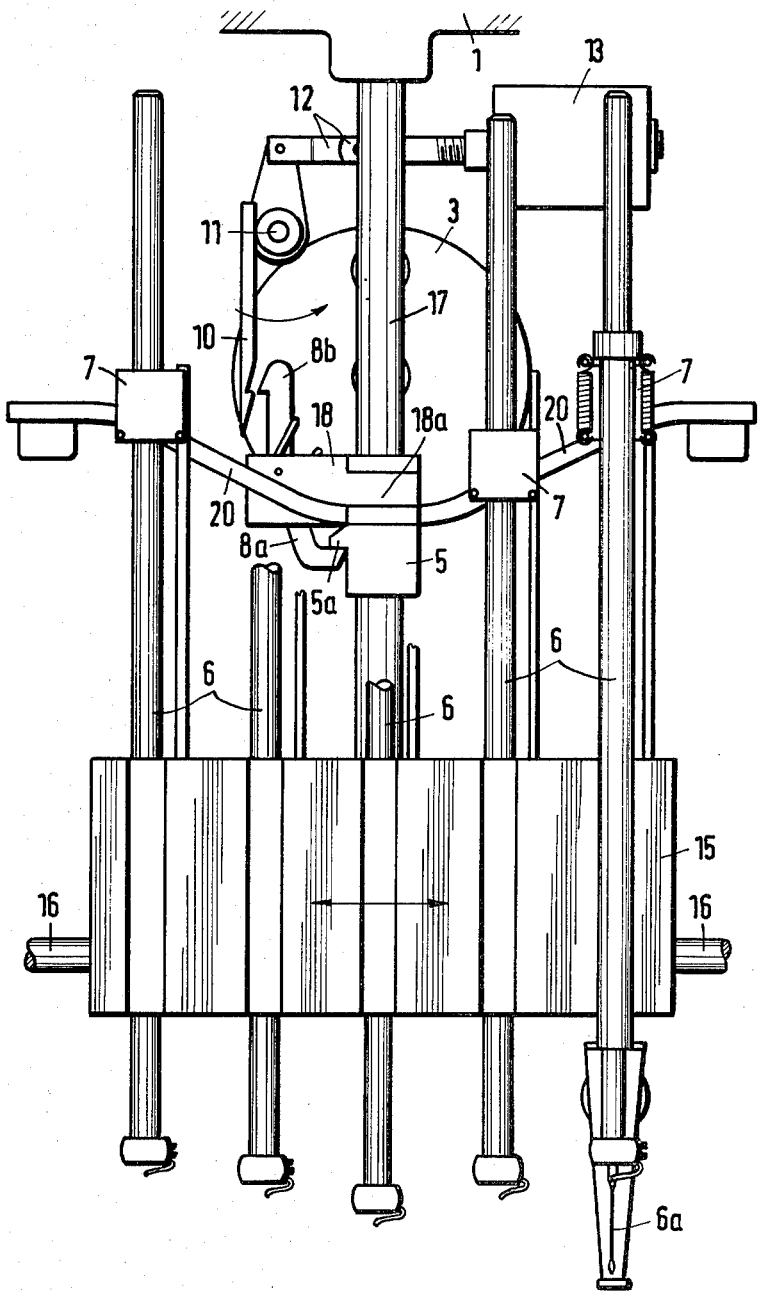
Figure 6:
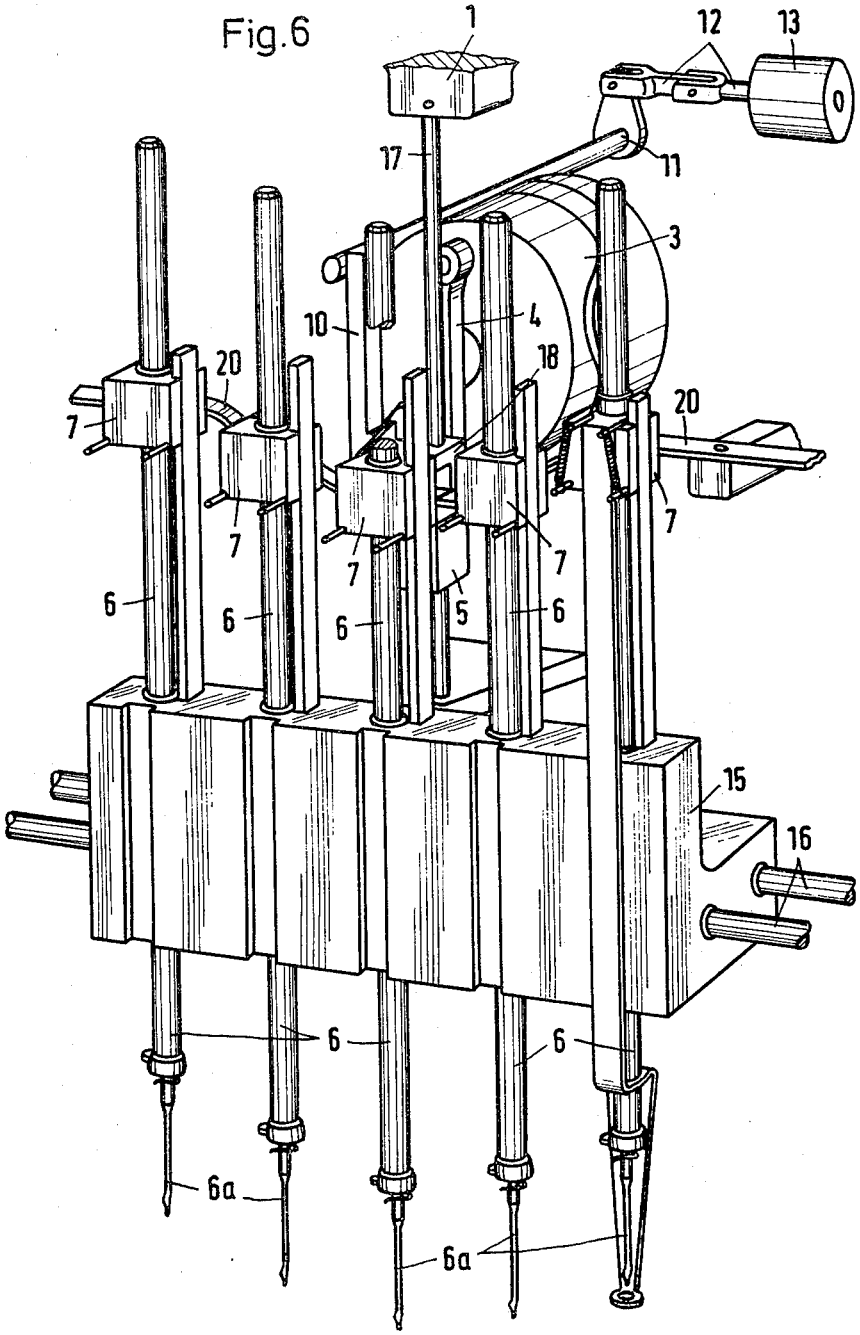

With the other objects and advantages in view, the present invention will become more clearly understood in connection with the detailed description of preferred embodiments, when considered with the accompanying drawings, of which:

FIG. 1 is a longitudinal section through a head of an embroidery machine,

FIG. 2 is a partially sectioned front view of FIG. 1 with a drive-ready needle bar or rod which is ready for working, FIG. 3 is a partially sectioned front view corresponding to FIG. 2 with disconnected needle bar, FIG. 4 is a longitudinal section through a head of an embroidery machine with a color change device, FIG. 5 is a front view of FIG. 4 and FIG. 6 is a perspective illustration of the embroidery head according to FIGS. 4 and 5.

The first embodiment example of a head of an embroidery machine according to FIGS. 1 to 3 shows the front part of a housing 1 with a main drive shaft 2. A crank 3 is fastened on the front end of the main drive shaft 2 by means of a pin 3*a*. A crank rod 4 is articulated to the crank 3, which crank rod is connected pivotally with the drive carriage 5 by means of a crank rod pin 4*a*.

This drive carriage 5 is moveably guided on a needle bar (rod ) 6, which needle bar 6 is moveably guided in the longitudinal direction in bearings bushings 1*a* of the housing 1. A driver 7 is fastened to the needle bar 6. A double-armed switch pawl 8 is mounted on the driver. This pawl 8 is biased by means of a leg spring 9.

While the lower arm 8*a* of the pawl 8 cooperates with a catch 5*a* of the drive carriage 5, so that the driver 7 can be connected with the drive carriage 5 according to FIG. 2, the upper arm 8*b* of the pawl 8 cooperates with a holding pawl 10. This holding pawl 10 is pivotably mounted on a bolt 11, the latter being arranged stationary in the housing. The holding pawl is actuated over a connecting rod mechanism 12 by a switching or drive magnet 13.

By means of the crank 3 and the crank rod 4 the drive carriage 5 is moved back and forth on the needle bar 6 with a turning main drive shaft 2. In the normal case, as it is illustrated in FIG. 2, the driver 7, which is fastened on the needle shank 6, is connected with the drive carriage 5 by means of the lower arm 8*a* of the pawl 8 and the catch 5*a*. The needle bar 6 and consequently the needle which is fastened to the needle bar 6 (however the needle not being illustrated in the drawing) are moved in this manner corresponding to the rotational speed of the main drive shaft 2. The positive non-slipping connection between the drive carriage 5 and the driver 7 is guaranteed as a result of the pawl 8 by means of the leg spring 9 which acts on the pawl 8.

If the embroidery needle movement is temporarily interrupted, for example during a displacement of the embroidery frame from one motif to the other, the switching magnet 13 is actuated, which magnet pivots the holding pawl 10 via the rod mechanism 12 in the direction of the arrow which is drawn in FIG. 2. As a consequence of this swinging movement the holding pawl 10 presses the upper arm 8*b* of the pawl 8 back against the force of the leg spring 9 as soon as the driver 7 again arrives in its upper deadpoint position. By this pressing back which is illustrated in FIG. 3, the lower arm 8*a* of the pawl 8 is uncoupled from the catch 5*a* of the drive carriage 5. The drive carriage 5 can now slide back and forth on the needle bar 6. By means of the holding pawl 10, to the contrary, the driver 7 is held secured or locked with the needle bar 6 in the upper deadpoint position as this is illustrated in FIG. 3.

By means of an actuation of the switching magnet 13 in this way it is possible, for example in dependency on the automatic control of the embroidery machine, to disconnect or stop the embroidery needle movement. This disconnection or switching-off can be entered in the program control of the embroidery or sewing machine in a simple manner. A renewed actuation of the switching magnet in the position illustrated in FIG. 3 results in a renewed coupling of the drive carriage 5 to the driver 7 of the needle bar as soon as the drive carriage 5 occupies its upper position according to FIG. 2. With high rotational speeds, preferably above 500 rotations per minute, in order to eliminate undesired movements of the needle bar 6 and of the driver 7, and to guarantee that the driver 7 is always located in the upper deadpoint position, the driver 7 is biased by means of a tension spring 14, which spring is suspended with its upper end on the housing 1 of the embroidery head.

The second embodiment according to FIGS. 4 to 6 schematically shows the head of an embroidery machine with a color change device. With the illustrated embodiment five needle rods (bars) 6 are moveably mounted in a needle rod block 15, which together with the needle bars 6 is displaceable on two bearing rods 16 in the direction of the arrow drawn in FIG. 5. Each needle bar 6 is thus mounted exclusively in the needle bar block 15, which block is displaceable at a right angle relative to the embroidery needle movement.

The needles 6*a* of the five needle bars 6 are each respectively provided with one yarn, which yarn either with respect to the color or other characteristics such as structure or thickness are differentiated from the other yarns. Only respectively from time to time one needle bar 6 can be located in the embroidery position which is drawn in FIG. 4. The other four needle bars 6 are respectively each disconnected.

In the embroidery position illustrated in FIG. 4, which is occupied in FIGS. 5 and 6 by the respective prevailing center needle bar 6, this needle bar 6 is connectable over the crank rod 4 and the crank 3 with the main drive shaft 2. With the embodiment form which is illustrated in FIGS. 4 to 6, this connection also is brought about over the drive slide carriage 5 which is moveably guided in the second embodiment on a guide rod 17, the latter being arranged parallel to the needle rods 6 in the housing 1. A contact piece 18 moreover is located on this guide rod 17, which contact piece carries the pawl 8. The lower arm 8*a* of the pawl 8 cooperates again with the catch 5*a* of the drive carriage 5, as this particularly is to be recognized in FIG. 5.

On its front side the contact member 18 is provided with a fork-like recess 18*a* which cooperates with a roller 19, which roller is arranged on the rearward side of each driver 7. The cooperation of this roller 19 with the fork-shaped recess 18*a* of the contact member 18 and the position of the roller 19 on the driver 7 of each needle bar 6 are best recognized in FIG. 4.

The actuation of the switch pawl 8 against the force of the leg spring 9 takes place as with the first embodiment form via the upper arm 8*b*, which upper arm cooperates with the holding pawl 10, and indeed by means of the switching magnet 13 (which can be recognized in FIG. 5) over the rod mechanism 12. The needle bar 6 which is located in the embroidery position consequently is connected positively without friction or slipping with the driver carriage 5 by means of the lower arm 8*a* of the switch pawl 8. Since the pawl 8 is not directly mounted on the driver 7 of the needle bar 6, which needle bar is found in the embroidery position, but rather on the contact piece 18, the latter which is guided moveably on the guide rod 17, there results an indirect connection over the fork-shaped recess 18*a* of the contact piece 18 in which there engages the roller 19, which roller 19 is arranged on the driver 7.

By a displacement of a needle bar block 15 transversely relative to the embroidery movement of the needle bars 6, which takes place by means of a transmission or mechanical gearing (not illustrated), that needle bar 6 which is to be driven by the main drive shaft 2 can be selected. With such a type of displacement movement of the needle bar block 15, the roller 19 of the needle shank 6, which needle bar is found originally in the embroidery position, steps laterally out from the fork-shaped recess 18*a* of the contact member 18. The roller 19 arrives on one of two stationary guide tracks or curves 20, the latter being arranged at both sides of the fork-shaped recess 18*a* of the contact member 18. These guide cams 20 are formed such that their spacing from the table of the embroidery or sewing machine increases with increasing distance from the contact piece 18. In this manner the needle bars 6 which are not found in the embroidery position are lifted further from the table than this corresponds to the upper dead-point positon. The needles 6*a* and needle bars 6, respectively, which are disposed out of engagement thus constitute no hinderance during the operation of the embroidery machine.

By the guide cams 20 it is guaranteed that the rollers 19 which are arranged on the drivers 7 are reliably inserted in the fork-shaped recess 18 of the contact piece 18, so that each of the five needle bars 6 when needed can be connected with the drive carriage 5. For example with the embodiment of shifting movements of the embroidery frame during the exchange of one finished pattern or motif to a new motif, the needle bar 6 which is found respectively at the time in the embroidery position can be uncoupled from the drive carriage 5. For this purpose the switching magnet 13 is actuated, which via the rod mechanism 12 pivots the holding pawl 10 in the direction of the arrow drawn in FIG. 5, the holding pawl being pivotable about the bolt 11. The holding pawl 10 cooperates after this pivoting with the upper arm 8*b* of the pawl 8 and secures this pawl 8 together with the contact piece 18 in the upper deadpoint position while the drive carriage 5 which is connected with the piston rod 4 is moved back and forth on the guide rod, since the catch 5*a* of the drive carriage 5 has been released from the lower arm 8*a* of the pawl 8 upon the pivoting movement of the pawl 8. The action for the intermittent or temporary interruption of the embroidery needle movement from time to time thus corresponds with the second embodiment according to FIGS. 4 to 6 of the previously explained action with respect to the first embodiment.

We claim:

1. Automatically controlled embroidery- or sewing machines, particularly multiple head automatic embroidery machines, with at least one needle bar for each head, the needle bar being operatively driven by means of a crank rod and a crank from a drive shaft, comprising a drive carriage pivotally connected with the piston rod, said drive carriage is formed with a first catch, a driver fastened on the needle bar, switch pawl means operatively connected to said driver for releasably connecting said drive carriage with said driver, said driver being securable in an upper deadpoint position upon simultaneous separation from the drive carriage, said switch pawl means is formed as a pivotally mounted double arm lever, one arm of said lever is connectable with said catch of said drive carriage for said connecting of said drive carriage with said driver, spring means for biasing said switch pawl means, holding pawl means for the temporary interruption of movement of the needle bar by disconnecting said switch pawl means from said first catch whereby said drive carriage is released from operative connection with said driver by said holding pawl means by swinging and positively non-frictionally securing said switch pawl means via the other arm of said switch pawl means against the force of said spring means in a position such that said one arm of said lever is non-engageable with said first catch of said drive carriage, and switching magnet means for controlling said holding pawl means, said switching magnet means being controlled by a program of an automatic control of the embroidery- or sewing machine.

2. The device as set forth in claim 1, wherein said drive carriage is moveably guided on said needle bar, and said switch pawl means is directly mounted on said driver.

3. The device as set forth in claim 1, further comprising a guide rod arranged parallel to said needle bar, said drive carriage is moveably guided on said guide rod, a contact piece is guided on said guide rod and is connected with said driver of the needle bar, said switch pawl means is mounted on said contact piece.

4. The device as set forth in claim 3, further comprising a common needle bar block, means for mounting the latter displaceably transversely to the embroidery movement, a plurality of the needle bars are mounted moveably parallel to one another in said common needle bar block, said driver of one of said needle bars which is disposed in an embroidery position at the time is connected with said contact piece.

5. The device as set forth in claim 4, further comprising a roller mounted on said driver of each of said needle bars, respectively, said contact piece is formed with a fork-shaped recess, said roller is insertable in said fork-shaped recess of said contact piece, respectively.

6. The device as set forth in claim 5, further comprising a stationary guide curve disposed at both sides of said contact piece, respectively, the latter being located in the upper deadpoint position, said rollers of the needle bars which are disposed outside of the embroidery position engage said guide curve.

7. The device as set forth in claim 6, wherein the distance of each said guide curve increases from a table of the embroidery- or sewing machine with increasing distance from said contact piece.

8. The device as set forth in claim 1, wherein said other arm of said lever operatively engages said holding pawl means.

9. The device as set forth in claim 1, further comprising a tension spring biases said driver, said tension spring pulls said driver into the upper deadpoint position.

10. The device as set forth in claim 1 wherein said spring means is for biasing said switch pawl means into operative connection with said first catch and with said holding pawl means, respectively.

11. The device as set forth in claim 10, wherein said other arm of said lever is formed with a second catch, said holding pawl means is formed with a third catch overlappingly engageable with said second catch of said other arm of said lever in the position such that said one arm of said lever is non-engageable with said first catch of said drive carriage, said spring means biasing said lever for maintaining engagement of said second and third catches, said switching magnet means for moving said holding pawl means and said third catch out of engagement from said second catch, such that then said spring means for biasing said switch pawl means into operative connection with said first catch of said drive carriage.

12. The device as set forth in claim 11, wherein said second catch of said other arm of said lever and said third catch of said holding pawl means are formed with external cooperating slide surfaces constituting means for swinging said switch pawl means out of engagement with said first catch of said drive carriage and for snapping said second and third catches into locking engagement in cooperation with said spring means.

13. Automatically controlled embroidery- or sewing machines, particularly multiple head automatic embroidery machines, with at least one needle bar for each head, the needle bar being operatively driven by means of a crank rod and a crank from a drive shaft, comprising a drive carriage pivotally connected with the piston rod, said drive carriage is formed with a first catch, a driver fastened on the needle bar, switch pawl means operatively connected to said driver for releasably connecting said drive carriage with said driver, said driver being securable in an upper deadpoint position upon simultaneous separation from the drive carriage, said switch pawl means is formed as a pivotally mounted double arm lever, one arm of said lever is connectable with said catch of said drive carriage for said connecting of said drive carriage with said driver, spring means for biasing said switch pawl means, holding pawl means for the temporary interruption of movement of the needle bar by disconnecting said switch pawl means from said first catch whereby said drive carriage is released from operative connection with said driver by said holding pawl means by swinging and positively non-frictionally securing said switch pawl means via the other arm of said switch pawl means against the force of said spring means in a position such that said one arm of said lever is non-engageable with said first catch of said drive carriage, and switching magnet means for controlling said holding pawl means, said switching magnet means being controlled by a program of an automatic control of the embroidery- or sewing machine.

14. The device as set forth in claim 13, wherein said switching magnet means further is for moving said holding pawl means from said inoperative position such that said external cooperating slide surfaces are in operative engageable range of each other.

15. The device as set forth in claim 1, wherein said one arm of said lever is formed with another catch engaging said first catch of said drive carriage.

16. The device as set forth in claim 1, wherein said holding pawl means for directly positively securing said switch pawl means by providing an upward non-frictional supporting force on said other arm of said lever.

17. The device as set forth in claim 1, further comprising means for moving said lever into said upper deadpoint position when said one arm is disconnected from said catch.

18. The device as set forth in claim 3, further comprising tension spring means for biasing and pulling said driver into the upper deadpoint position.

* * * * *

UNITED STATES PATENT AND TRADEMARK OFFICE

CERTIFICATE OF CORRECTION

PATENT NO. : 4,254,721

DATED : March 10, 1981

INVENTOR(S) : Wofgang Teetz, et al

It is certified that error appears in the above-identified patent and that said Letters Patent are hereby corrected as shown below:

The following claim should be added:

--19. The device as set forth in claim 11, wherein said switching magnet means is for moving said holding pawl means and said third catch out of engagement from said second catch and simultaneously into an inoperative position such that said external cooperating slide surfaces are non-engageable with each other.--

On the title page after the abstract, "18 Claims" should read -- 19 Claims --.

Signed and Sealed this

Sixteenth Day of June 1981

[SEAL]

Attest:

RENE D. TEGTMEYER

Attesting Officer

Acting Commissioner of Patents and Trademarks